US007857143B2

(12) United States Patent
Oku et al.

(10) Patent No.: US 7,857,143 B2
(45) Date of Patent: Dec. 28, 2010

(54) SUCTION FILTER AND FUEL SUPPLY DEVICE

(75) Inventors: Toshihide Oku, Suzuka (JP); Tetsuya Hara, Nagoya (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 182 days.

(21) Appl. No.: 12/078,080

(22) Filed: Mar. 27, 2008

(65) Prior Publication Data

US 2008/0245724 A1 Oct. 9, 2008

(30) Foreign Application Priority Data

Apr. 6, 2007 (JP) ..... 2007-100153

(51) Int. Cl.
*F02M 37/22* (2006.01)

(52) U.S. Cl. ..... 210/416.4; 210/489

(58) Field of Classification Search ..... 210/416.1, 210/416.4, 488, 489
See application file for complete search history.

(56) References Cited

U.S. PATENT DOCUMENTS

| | | | | |
|---|---|---|---|---|
| 1,601,503 | A * | 9/1926 | Munro | 210/416.4 |
| 4,304,664 | A * | 12/1981 | McAlindon et al. | 210/172.3 |
| 5,511,957 | A * | 4/1996 | Tuckey et al. | 417/313 |
| 5,860,796 | A * | 1/1999 | Clausen | 417/423.9 |
| 5,876,599 | A | 3/1999 | Sylvester | |
| 6,382,190 | B1 * | 5/2002 | Tanabe et al. | 123/509 |
| 6,555,000 | B2 * | 4/2003 | Knight | 210/416.4 |
| 6,746,603 | B2 * | 6/2004 | Harvey et al. | 210/234 |
| 6,878,275 | B2 * | 4/2005 | Yamada | 210/416.4 |
| 6,887,388 | B2 * | 5/2005 | Winn et al. | 210/739 |
| 6,929,742 | B2 * | 8/2005 | Wehrum et al. | 210/257.1 |
| 2003/0071146 | A1 | 4/2003 | Yamada | |
| 2006/0048756 | A1 | 3/2006 | Ikeya | |
| 2008/0107549 | A1 * | 5/2008 | Crary et al. | 417/410.1 |

FOREIGN PATENT DOCUMENTS

| | | |
|---|---|---|
| DE | 19619992 | * 11/1997 |
| JP | 2003-269277 | * 9/2003 |
| JP | 2006144553 | 6/2006 |
| JP | 2006194239 | 7/2006 |
| JP | 2006226222 | 8/2006 |
| WO | WO 02/079634 | 10/2002 |

OTHER PUBLICATIONS

Machine-assisted English translation of DE19619992, generated Nov. 20, 2009.*
Machine-assisted English translation of JP 2003-269277, generated Nov. 20, 2009.*

* cited by examiner

*Primary Examiner*—Fred Prince
(74) *Attorney, Agent, or Firm*—Dennison, Schultz & MacDonald

(57) ABSTRACT

A suction filter may comprise a filtration member and a connection member. The filtration member has an inner space. The connection member is configured to communicate the inner space of the filtration member and a fuel intake port of a fuel pump. The filtration member may have a tubular shape so that the filtration member surrounds a circumference of the fuel pump when the suction filter is connected to the fuel intake port of the fuel pump.

19 Claims, 13 Drawing Sheets

SUCTION FILTER AND FUEL SUPPLY DEVICE

CROSS-REFERENCE TO RELATED APPLICATION

This application claims priority to Japanese Patent Application No. 2007-100153 filed on Apr. 6, 2007, the contents of which are hereby incorporated by reference into the present application.

BACKGROUND OF THE INVENTION

1. Field of the Invention

The present invention relates to a fuel supply device for supplying fuel within a fuel tank to the outside of the fuel tank. In particular, the present invention relates to a suction filter connected to an intake port of a fuel pump.

2. Description of the Related Art

This type of fuel supply device comprises a fuel pump and a suction filter connected to the intake port of the fuel pump. The suction filter is a member for removing foreign matter contained in the fuel. In this fuel supply device, foreign matter adheres to the surface of the suction filter over time, and the filtration resistance gradually increases. This increase in the filtration resistance leads to a decline in fuel pump efficiency In order to delay the increase in filtration resistance of the suction filter, it is necessary to increase the filtration surface area of the suction filter. However, a mere increase in the filtration surface area of the suction filter results in increased size of the fuel supply device. Japanese Laid-open Patent Publication No. 2006-144553 discloses a fuel supply device. This fuel supply device has a connection pipe that communicates an inner space of a suction filter and a fuel intake port of a fuel pump. This connection pipe is bent so that the suction filter is disposed along the longitudinal direction of the fuel pump. In this fuel supply device, the increase in the device size is avoided, while increasing the filtration surface area of the suction filter, by disposing the suction filter in the longitudinal direction of the fuel pump.

BRIEF SUMMARY OF THE INVENTION

However, in conventional fuel supply device, the filtration area of the fuel filter has not been large enough, and it has not been possible to delay the increase in filtration resistance of the suction filter adequately.

It is an object of the present teachings to provide a technology that makes it possible to increase the filtration area of the suction filter, while suppressing the increase in the device size.

In one aspect of the present teachings, a suction filter may comprise a filtration member and a connection member. The filtration member has an inner space. For example, the filtration member may have a first filtration surface and a second filtration surface. The first filtration surface and second filtration surface may be partially connected (e.g., peripheral edges thereof are bonded together). As a result, an inner space can be provided between the first filtration surface and the second filtration surface. The connection member is configured to communicate the inner space of the filtration member and a fuel intake port of a fuel pump. The connection member may have a first connection portion configured to be connected to the fuel intake port of the fuel pump. The foreign matter contained in the fuel can be removed when the fuel flows from the outside of the filtration member to the inner space of the filtration member. The removed foreign matter is accumulated in the surface of the filtration member. The fuel from which the foreign matter has been removed passes through the inner space and flows to the fuel intake port of the fuel pump via the connection member. Preferably, the filtration member has a tubular shape so that the filtration member surrounds a circumference of the fuel pump when the first connection portion of the connection member is connected to the fuel intake port of the fuel pump. In this suction filter, since the filtration member surrounds the circumference of the fuel pump when the suction filter is connected to the fuel pump, it is possible to increase the filtration surface area of the filtration member, while suppressing the increase in the device size.

The "tubular-shaped filtration member" may include not only members that arc provided with a tubular shape by curving or bending a sheet-like filtration member, but also other various forms. For example, a filtration member may comprise a plurality of sheet-like filtration portions. Each filtration portion may have an inner space. This filtration portions may be disposed side by side in the circumferential direction with respect to an axial line of the fuel pump. Further, each filtration portion may be curved or bent in the circumferential direction with respect to the axial line of the fuel pump. Furthermore, the filtration portions may be also disposed with a certain spacing in the circumferential direction (i.e., a slit (or notch) may be provided in the circumferential direction of the tubular filtration member). Where a slit is formed in the circumferential direction of the tubular-shaped filtration member, other functional components (e.g., a jet pump) can be disposed in this portion. Therefore, the resultant configuration can be adapted to fuel supply devices of various types.

Further, the connection member may be connected to the filtration member in at least one location in a circumferential direction of the tubular-shaped filtration member. Alternatively, the connection member may be connected to the filtration member along the entire circumference of the filtration member. For example, the connection member may comprise a first sheet portion and a second sheet portion. Each of peripheral edges of the first sheet portion and the second sheet portion may be connected to the tubular-shaped filtration member. A fuel flow path may be provided between the first sheet portion and second sheet portion. One of the first sheet portion and second sheet portion may have the first connection portion.

In another aspect of the present teachings, the connection member may further have a second connection portion connected to the filtration member, and the second connection portion may have a shape gradually expanding toward the filtration member (i.e., a shape such that the cross section area of the fuel flow path increases gradually toward the filtration member). In conventional fuel supply device, a flow of fuel inside the connection member is not taken into account. As a result, when the fuel is taken into the fuel pump via the connection member, a turbulence occurs in the flow of fuel inside the connection member. Where such turbulence occurs in the fuel flow, vapor appears in the fuel or pressure loss occurs and a load is applied to the fuel pump. As a result, the fuel pump efficiency is decreased. However, when the second connection portion has a shape gradually expanding toward the filtration member, the fuel that passed through the filtration member can smoothly flow into the connection member. Therefore, the flow disturbance in the fuel can be inhibited and the occurrence of vapor or pressure loss in the second connection portion can be reduced. As a result, the load applied to the fuel pump can be reduced and pump efficiency can be increased.

The connection member may be formed from a resin material. Further, it is preferred that the connection member has a certain rigidity. Furthermore, it is preferred that an inner surface (i.e., an inner wall surface of the fuel flow path) of the connection member is formed as a smooth surface. As a result, flow disturbance in the fuel can be further inhibited and the load applied to the fuel pump can be further reduced.

Further, the filtration surface area of the filtration member is preferably larger than a cross section area (i.e., cross section area of the fuel flow path) of the second connection portion of the connection member. Where the filtration surface area of the filtration member is increased, clogging of the suction filter can be greatly delayed. As a result, the decrease in fuel pump efficiency can be prevented.

In another aspect of the present teachings, the above-described suction filters may be connected to the fuel pump, thereby making it possible to configure a fuel supply devices. In this case, the filtration member is preferably arranged with respect to the fuel pump so that the axial direction of the tubular-shaped filtration member coincides with the longitudinal direction of the fuel pump and the circumference (i.e., outer surface) of the fuel pump is surrounded by the tubular filtration member. With such a configuration, a compact device of reduced size can be obtained, while increasing the filtration surface area of the filtration member.

Further, the above-described fuel supply devices may be disposed within a reservoir cup. In this case, it is preferred that the fuel supply device is so disposed inside the reservoir cup that a gap is formed in at least one location in the circumferential direction between the inner wall of the reservoir cup and the outer peripheral surface of the filtration member. This is because where the inner wall of the reservoir cup and the outer peripheral surface of the filtration member are in tight contact with one another, the outer peripheral surface of the filtration member does not function as a filtration portion and the filtration surface area of the filtration member decreases. By providing a gap between the inner wall of the reservoir cup and the outer peripheral surface of the filtration member, it is possible to perform filtration by the outer peripheral surface of the filtration member.

Further, the reservoir cup may have a protrusion (e.g., a rib) on the inner wall of the bottom surface thereof. This protrusion may be in contact with the connection member. With such a configuration, the suction filter can be supported by the protrusion at the bottom surface of the reservoir cup in a state such that the lower end of the filtration member floats above the bottom surface of the reservoir cup. Therefore, the filtration member can be prevented from being pressed against the bottom surface of the reservoir cup and deformed. By preventing the deformation of the filtration member, it is possible to prevent the decrease in the filtration surface areas of the suction filter.

The connection member may have a filtration portion in part thereof. In such case, the filtration surface area can be further increased and the decrease in fuel pump efficiency can be prevented more efficiently.

Other objects, features and advantages of the present teachings will be readily understood after reading the following detailed description together with the accompanying drawings and claims. Of course, the additional features and aspects disclosed herein may be utilized singularly or, in combination with the above-described aspect and features.

BRIEF DESCRIPTION OF THE DRAWINGS

DETAILED DESCRIPTION OF THE INVENTION (Embodiment 1) The suction filter of the first representative embodiment of the present teachings will be described below with reference to the appended drawings. The fuel supply device of the present embodiment can be attached to a fuel tank of an automobile and used to supply fuel to an engine. As shown in FIG. 1, the fuel supply device comprises a fuel discharge portion 14 and a fuel pump portion 16. The fuel discharge portion 14 is mounted on an opening 12*a* of a fuel tank 12 and covers the opening 12*a*. The fuel pump portion 16 is inserted from the opening 12*a* and disposed within the fuel tank 12.

Figure 1:
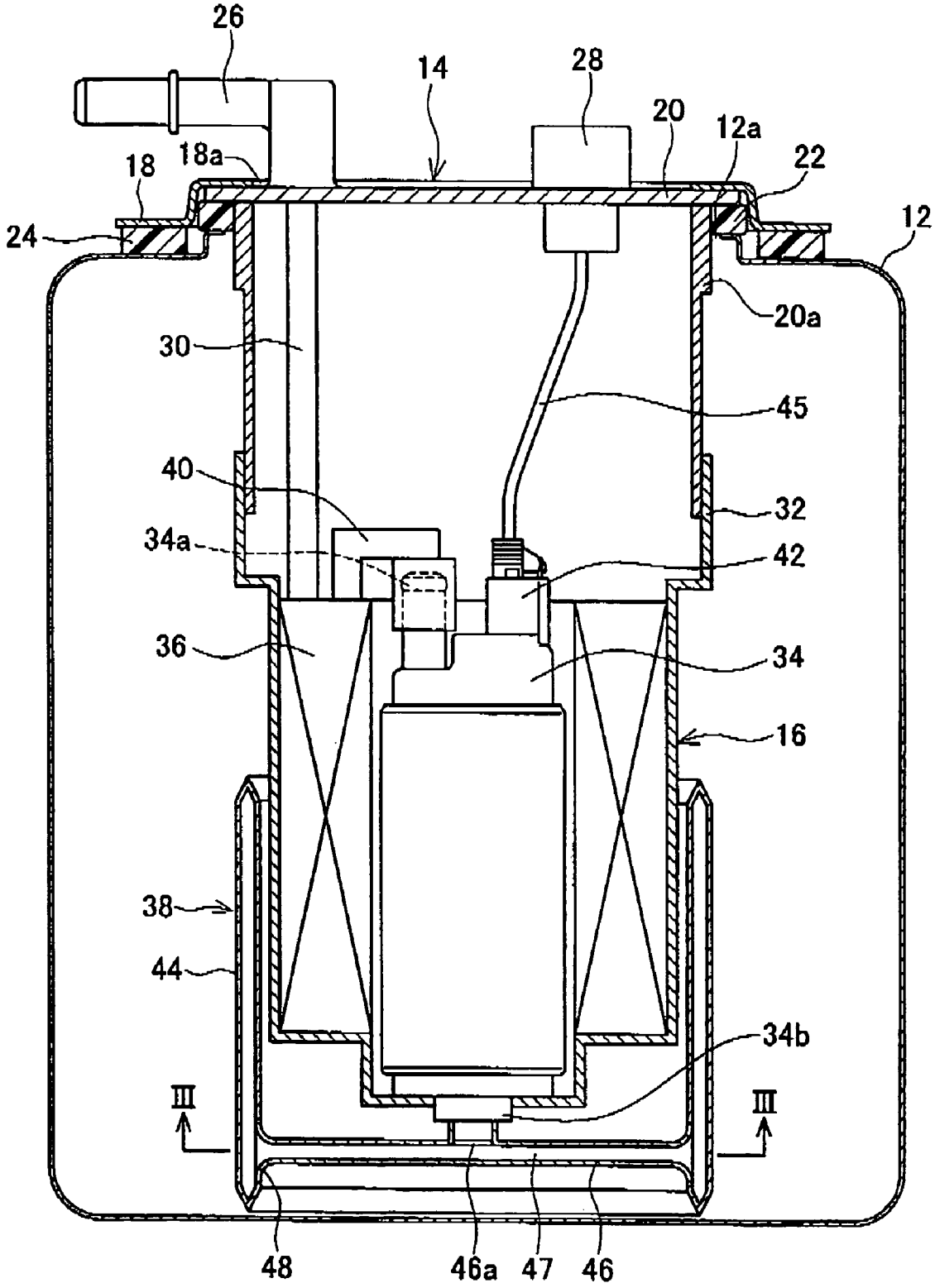
FIG. 1 is a vertical sectional view of the fuel supply device of the first embodiment of the present teachings.

The fuel discharge portion 14 has a ring plate 18 and a lid member 20 that covers an opening 18*a* of the ring plate 18. A fuel discharge port 26 and a connector 28 are formed on the upper surface of the lid member 20. The fuel discharge port 26 is connected to one end of a fuel supply pipe (not shown in the figure). The other end of the fuel supply pipe is connected to the engine. The connector 28 is connected via a conductor wire (not shown in the figure) to an external power source. A connection section 20*a* that has an almost cylindrical shape extending vertically is formed on the lower surface of the lid member 20. A sealing member 22 is disposed between the lower surface of the peripheral edge of the lid member 20 and the upper surface of the fuel tank 12. A fixing member 24 that fixes the ring plate 18 to the fuel tank 12 is disposed between the lower surface of the outer peripheral edge of the ring plate 18 and the upper surface of the fuel tank 12. The lid member 20 is disposed so as to cover the opening 12*a* of the fuel tank 12, and the ring plate 18 is disposed so that the inner peripheral edge thereof is pressed against the peripheral edge of the lid member 20. With such a configuration, the fuel supply device is liquid-tightly fixed to the fuel tank 12.

The fuel pump portion 16 comprises a housing 32, a fuel pump 34, a fuel filter 36, and a suction filter 38. The casing 32 has a substantially cylindrical shape that is open at the upper end and accommodates inside thereof the well-known fuel pump 34 and fuel filter 36. The connection section 20*a* of the lid member 20 is mated with the upper end of the casing 32. Thus, the fuel pump portion 16 is held in a suspended state on the lower surface of the lid member 20. The fuel pump 34 is accommodated inside the casing 32 so that the axial line thereof is perpendicular to the opening of the fuel tank 12 and also so that a discharge port 34*a* is on the upper side and an intake port 34*b* is on the lower side. The discharge port 34*a* is connected to the fuel filter 36 via a connection pipe 40. The fuel filter 36 is connected to the fuel discharge port 26 via a connection pipe 30. A pressure regulator (not shown in the figure) is provided in the connection pipe 30. A connector 42 is formed at the upper end of the fuel pump 34. The connector 42 is connected to the connector 28 via a conductor wire 45.

Figure 2:
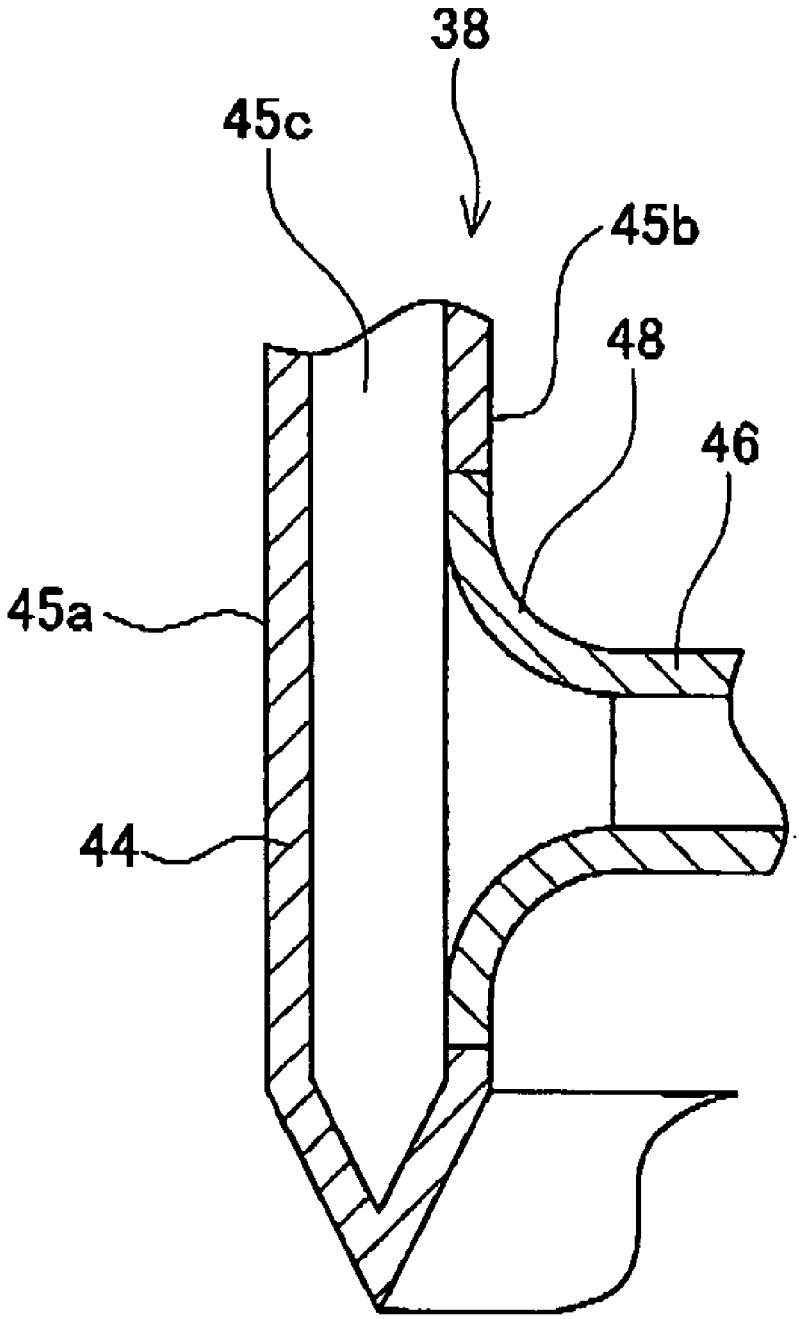
FIG. 2 is an enlarged view of the connection portion of the device shown in FIG. 1.
Figure 3:
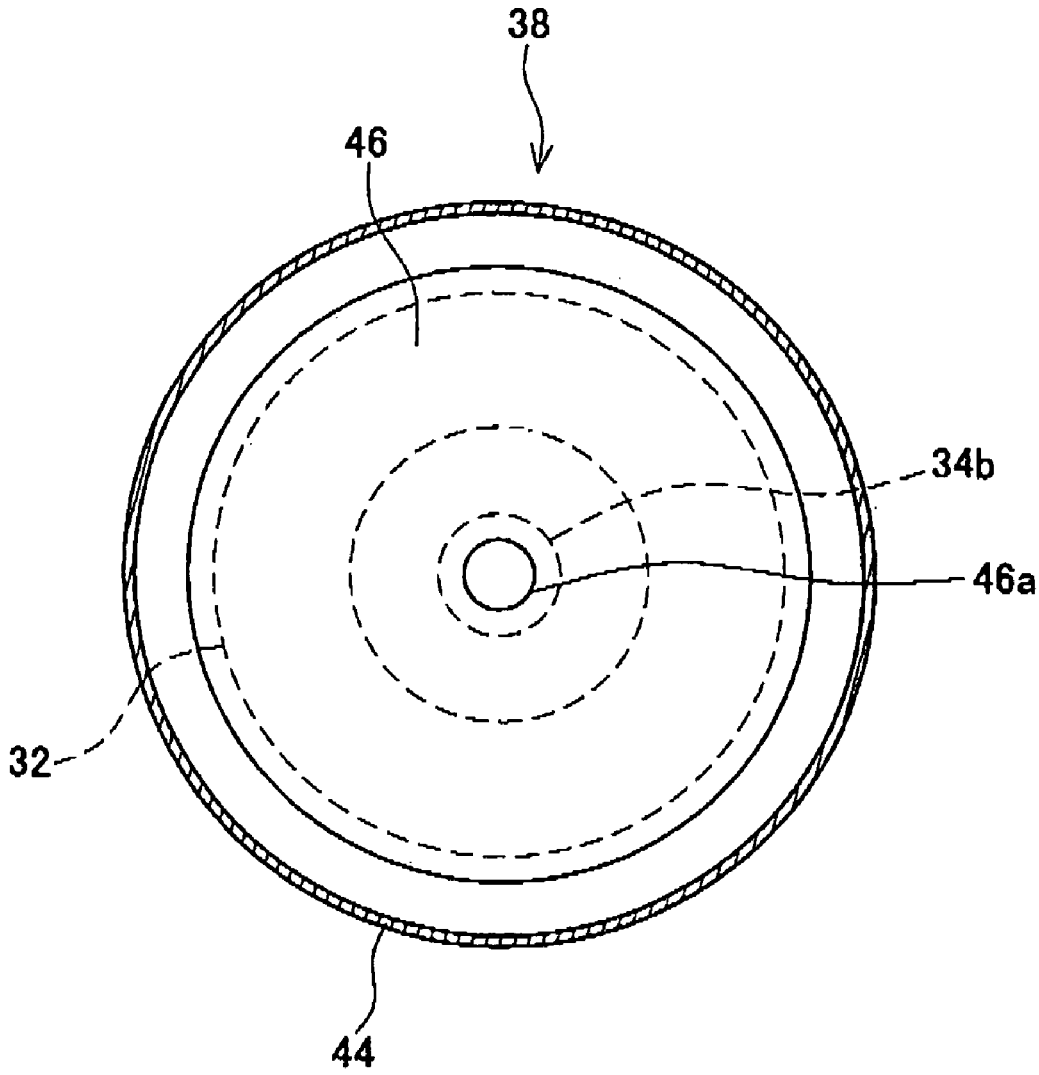
FIG. 3 is a sectional view along the III-III line in FIG. 1.

The suction filter 38 has a resin frame (not shown in the figure) and a bag-shaped mesh 44 covering the frame. The frame has a substantially cylindrical shape, and the mesh 44 is held by the frame so as to assume a substantially cylindrical shape as a whole (as shown in FIG. 1 to FIG. 3). An outer peripheral surface 45*a* and an inner peripheral surface 45*b* of the mesh 44 are connected at the upper and lower ends thereof, and an inner space 45*c* is formed between the outer peripheral surface 45*a* and the inner peripheral surface 45*b* (see FIG. 2).

The suction filter also has a fuel channel member 46. The fuel channel member 46 is connected to one end (i.e., close to the lower end portion) of the substantially cylindrical-shaped mesh 44. The fuel channel member 46 comprises two disk-shaped sheets (i.e., upper sheet and lower sheet). A fuel flow path 47 is formed between the two sheets of the fuel channel member 46. The fuel channel member 46 is made from a resin material and has a certain rigidity. Further, the opposite surfaces of the two sheets are formed to be smooth (i.e., the inner wall surface of the fuel channel member 46 is formed to be smooth). A connection portion 46*a* for connection to the fuel pump 34 is formed at the upper surface of the fuel channel member 46. The connection portion 46*a* is connected to the intake port 34*b* of the fuel pump 34. The fuel channel member 46 further comprises a connection portion 48 for connection to the mesh 44. As shown in FIG. 2, the connection portion 48 that is connected to the inner peripheral surface 45*b* of the mesh 44 has a trumpet-like shape expanding toward the mesh 44. Thus, the peripheral edge portion of the fuel channel member 46 expands in the up-down direction, and the vertical cross section of the expansion portion has a circular arc shape. The outer diameter of the suction filter 38 (i.e., the outer diameter of the mesh 44) is somewhat less than the diameter of the opening 12*a* of the fuel tank 12. The axial direction of the suction filter 38 coincides with the longitudinal direction of the fuel pump 34, and the suction filter 38 is disposed so as to surround the outer peripheral surface and lower portion of the casing 32 (i.e., the fuel pump 34). A gap is formed between the inner peripheral surface 45*b* of the suction filter 38 and the outer peripheral surface of the casing 32. A gap is also formed between the outer peripheral surface 45*a* of the suction filter 38 and the fuel tank 12.

The operation of the fuel supply device will be explained below. When electric power is supplied from the external power source to the fuel pump 34, the fuel pump 34 is actuated. When the fuel pump 34 is actuated, the fuel within the fuel tank 12 is sucked from the outside (i.e., outer peripheral surface 45*a* and inner peripheral surface 45*b*) of the mesh 44 of the suction filter 38 to the inside (i.e., the inner space 45*c*). At this time, the fuel is filtered by the mesh 44, and foreign matter contained in the fuel adheres to the outer surface (i.e., outer peripheral surface 45*a* and inner peripheral surface 45*b*) of the mesh 44. The fuel from which the foreign matter has been removed flows from the inner space 45*c* of the mesh 44 into the fuel channel member 46. The fuel flowing through the fuel channel member 46 is taken from the intake port 34*b* into the fuel pump 34. The fuel taken into the fuel pump 34 is pressurized and discharged from the discharge port 34*a* The fuel discharged from the discharge port 34*a* is sent to the fuel filter 36 and filtered again. The pressure of the fuel discharged from the fuel filter 36 is regulated by the pressure regulator to a pressure corresponding to the operation state of the engine. The fuel with a regulated pressure is supplied from the fuel discharge port 26 to the engine.

In the fuel supply device of the present embodiment, the mesh 44, which is a fuel filtration portion of the suction filter 38, is formed to have a cylindrical shape and extends in the up-down direction along the circumferential surface of the fuel pump 34. As a result, the increase in size of the fuel supply device can be inhibited, while increasing the filtration surface area of the mesh 44. Further, the connection portion 48 of the fuel channel member 46 has a trumpet-like shape that expands toward the mesh 44. Therefore, the fuel that passed through the mesh 44 can flow smoothly into the fuel channel member 46, and the occurrence of vapor in the connection portion 48 or pressure loss in the connection portion 48 can be inhibited. As a consequence, a load applied to the fuel pump 34 can be decreased and pump efficiency can be further increased.

Other embodiments of the present teachings will be described below. The difference between the fuel supply device of the below-described embodiments and the fuel supply device of the first embodiment is only in part of the configuration of a fuel pump portion 66. Accordingly, in the explanation below, only the difference between these embodiments and the first embodiment will be explained, and redundant explanation will be omitted. Components common with the fuel supply device of the first embodiment will be denoted by identical reference symbols.

Figure 4:
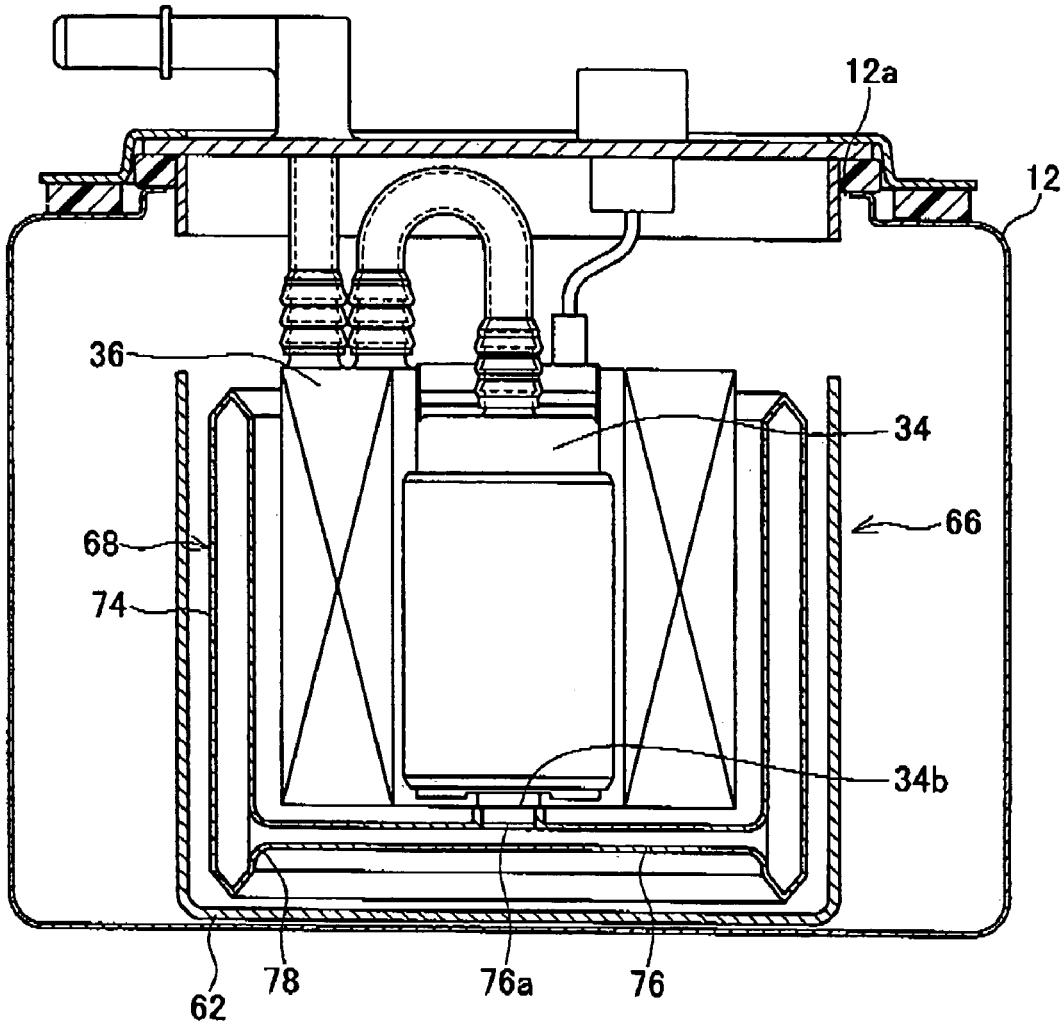
FIG. 4 is a vertical sectional view of the fuel supply device of the second embodiment.

(Embodiment 2) The second embodiment of the present teachings will be described below. As shown in FIG. 4, the fuel tank 12 has a reservoir cup 62 disposed in the bottom portion of the fuel tank 12. The fuel pump portion 66 is disposed within the reservoir cup 62. The fuel pump portion 66 comprises a fuel pump 34, a fuel filter 36, and a suction filter 68. The fuel filter 36 has a substantially cylindrical shape and is disposed around the fuel pump 34. The suction filter 68 is configured in the same manner as in the first embodiment. Thus, the suction filter 68 has a mesh 74 of a substantially cylindrical shape and a disk-shaped fuel channel member 76 connected to the lower portion of the mesh 74. A connection portion 78 of the fuel channel member 76 has a trumpet-like shape similar to that of the first embodiment. A connection portion 76*a* is formed at the upper surface of the fuel channel member 76. The connection portion 76*a* is connected to an intake port 34*b* of the fuel pump 34. The suction filter 68 is disposed so as to surround the outer peripheral surface and lower portion of the fuel filter 36. The reservoir cup 62 has a substantially cylindrical shape, and the upper end thereof is open and has a bottom portion. The reservoir cup 62 accommodates the fuel pump 34, fuel filter 36, and suction filter 68. A gap is formed between the outer peripheral surface of the suction filter 68 and the inner peripheral surface of the reservoir cup 62. The outer diameter of the reservoir cup 62 is somewhat less than the diameter of an opening 12*a* of the fuel tank 12.

In the fuel supply device of the present embodiment, the suction filter 68 is disposed between the fuel filter 36 surrounding the periphery of the fuel pump 34 and the reservoir cup 62. As clearly sheen in the figure, the mesh 74, which is a fuel filtration portion of the suction filter 68, extends in the up-down direction along the circumferential surface of the fuel pump 34 and is disposed so as to overlap the fuel pump 34 in the axial direction. Therefore, in the fuel supply device of the present embodiment, the filtration surface area can be increased, without increasing the size of the apparatus. Further, the connection portion 78 of the fuel channel member 76 has a trumpet-like shape, as in the first embodiment, and the pressure loss of fuel in the connection portion 78 can be reduced. As a result, the load applied to the fuel pump 34 can be decreased and the efficiency of fuel pump 34 can be increased.

Figure 5:
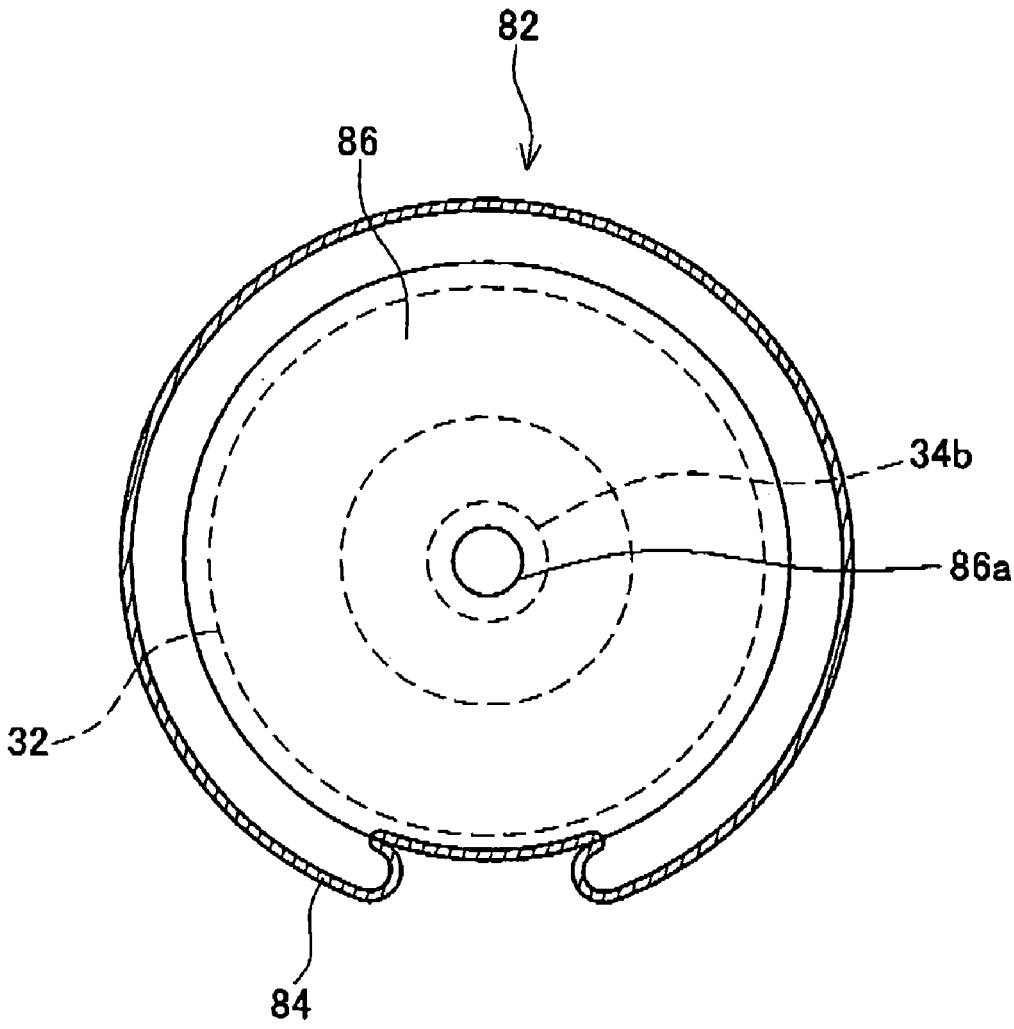
FIG. 5 is a sectional view of the fuel supply device of the third embodiment, this view being corresponding to the sectional view along the III-III line in FIG. 1.

(Embodiment 3) The third embodiment of the present teachings will be described below. In the fuel supply device of the present embodiment, the shape of a suction filter 82 is different from that of suction filters of the above-described embodiments. As shown in FIG. 5, a notch (or slit) is formed in part of a mesh 84 held to have a cylindrical shape (thus, the horizontal cross section of the mesh 84 has a circular arc shape). A disk-shaped fuel channel member 86 is disposed in the lower portion of the mesh 84. An outer end portion of the fuel channel member 86 is connected to the mesh 84 and closed in a portion where the notch is formed in the mesh 84. The connection portion of the fuel channel member 86 has a trumpet-like shape similar to that in the first embodiment. A connection portion 86*a* for connecting to an intake port 34*b* of the fuel pump 34 is formed at the upper surface of the fuel channel member 86.

In the fuel supply device of the present embodiment, a notch is provided in the mesh 84 of the suction filter 82. As a result, the mesh 84 can be easily formed to have a bag-like shape and the productivity can be greatly increased. Further, because other functional components (e.g., a jet pump) can be disposed in the notched portion, the suction filter can be adapted to devices of various configurations.

Figure 6:
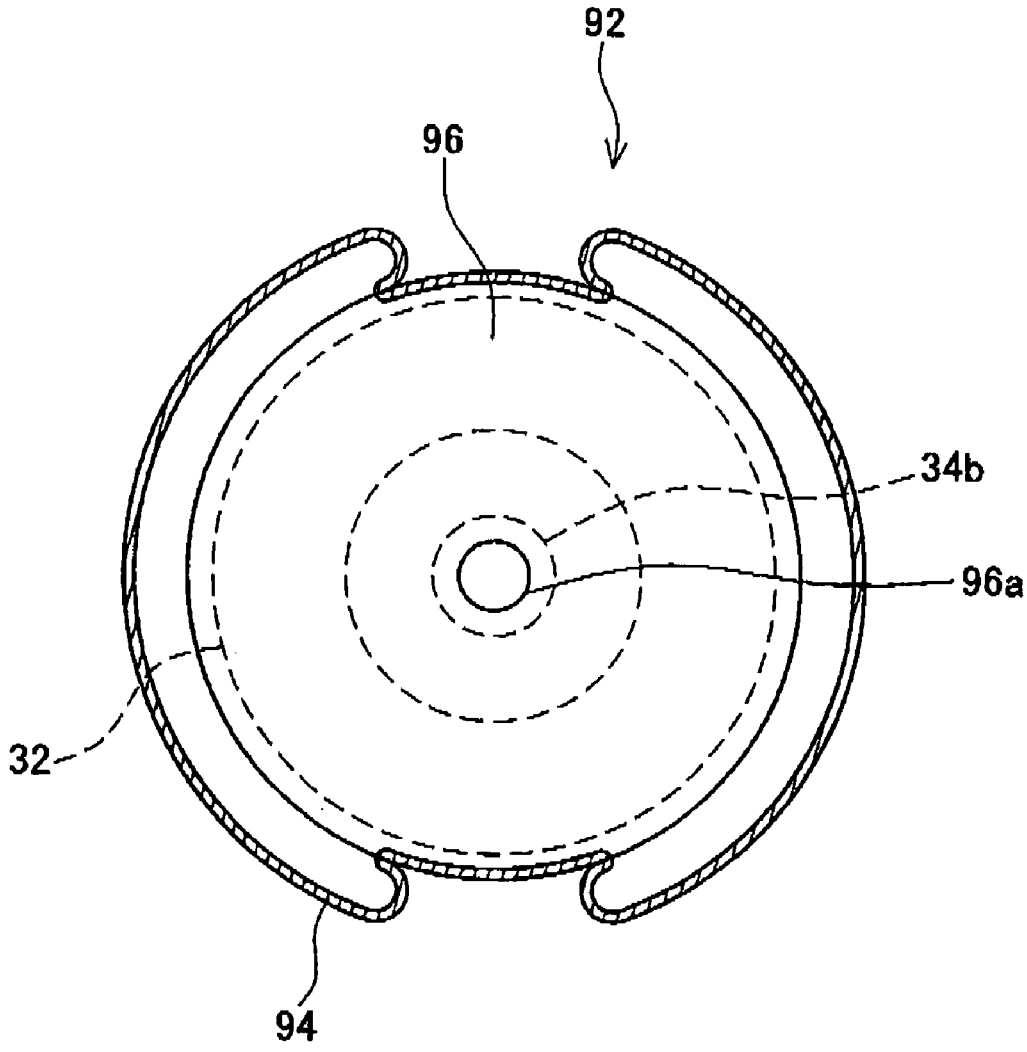
FIG. 6 is a sectional view of the fuel supply device of the fourth embodiment, this view being corresponding to the sectional view along the III-III line in FIG. 1.

(Embodiment 4) The fourth embodiment of the present teachings will be described below. In the present embodiment, the shape of a suction filter 92 is different from that of suction filter of the third embodiment. As shown in FIG. 6, notches (or slits) are formed in two locations in the circumferential direction of a mesh 94 (the mesh 94 is split into two sections by the notches (i.e., the mesh 94 has two filtration portions)). The two notches are formed in opposing locations. In the present embodiment, the two notches of the mesh 94 are disposed in the opposing locations, but the position of the notches can be changed appropriately (e.g., they can be changed appropriately according to the arrangement of other functional components (a jet pump)). A disk-shaped fuel channel member 96 is provided in the lower part of the mesh 94. The outer end portion of the fuel channel member 96 is connected to the mesh 94 and is closed by a portion where the notch is formed in the mesh 94. The connection portion of the fuel channel member 96 has a trumpet-like shape similar to that of the first embodiment. A connection portion 96*a* for connection to an intake port 34*b* of the fuel pump 34 is formed at the upper surface of the fuel channel member 96.

In the fuel supply device of the present embodiment, two notches are provided in the mesh 94 of the suction filter 92 and the mesh is divided in two section. Such a configuration also makes it possible to manufacture the mesh 94 in an easy manner. Furthermore, because other functional components (e.g., a jet pump) can be disposed in the notched portion, the suction filter can be adapted to devices of various configurations. The suction filter 92 of the present embodiment can be used as a suction filter of the fuel supply devices of the above-described other embodiments.

Figure 7:
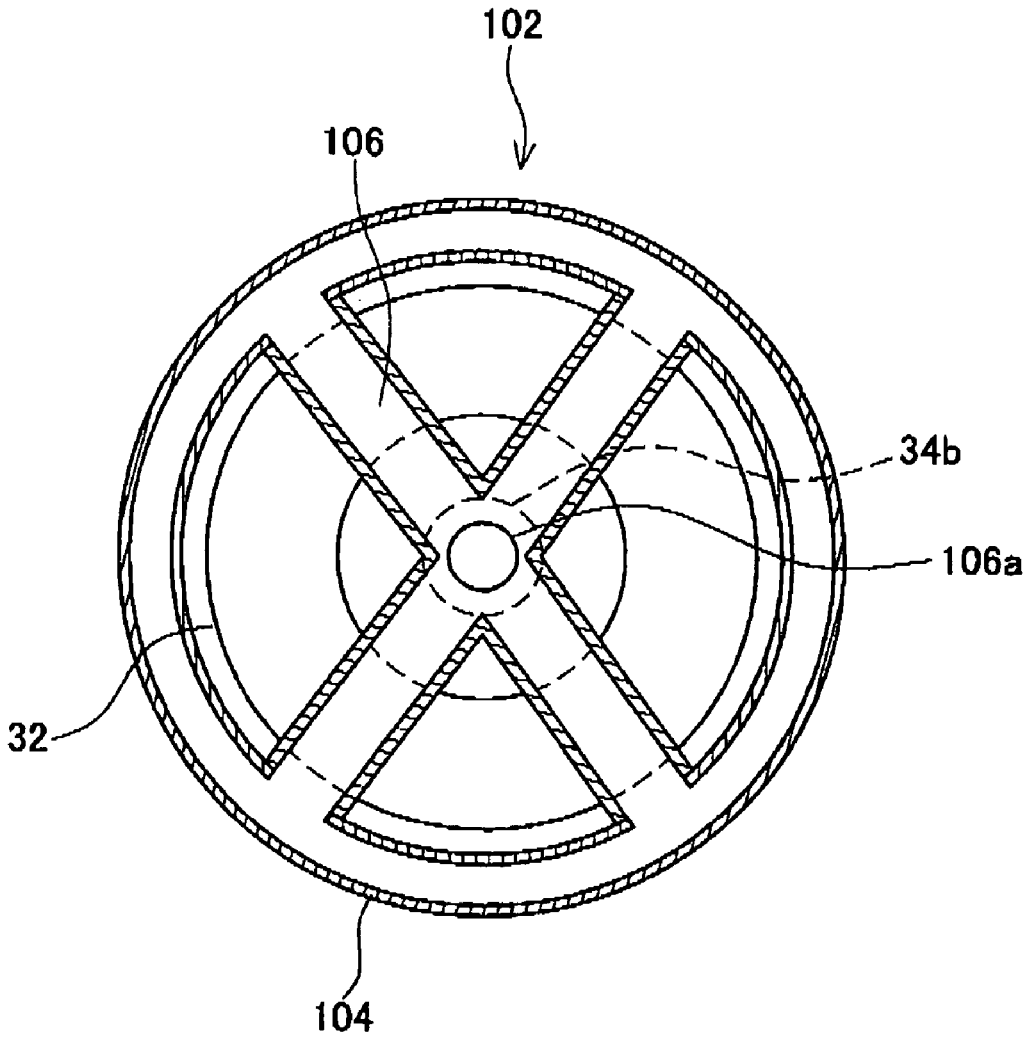
FIG. 7 is a sectional view of the fuel supply device of the fifth embodiment, this view being corresponding to the sectional view along the III-III line in FIG. 1.

(Embodiment 5) The fifth embodiment of the present teachings will be described below. In the present embodiment, the shape of a fuel channel 106 of a suction filter 102 is different from that of suction filters of the first embodiment or second embodiment. As shown in FIG. 7, in the suction filter 102 of the present embodiment, two tubular fuel channel members 106 are connected in the lower part of a mesh 104. The fuel channel members 106 intersect in the center of the mesh 104. Both ends of each fuel channel member 106 are connected to the mesh 104, and each connection portion is formed to have a trumpet-like shape, similarly to the first embodiment. A connection portion 106*a* for connection to an intake port 34*b* of the fuel pump 34 is formed in a portion where the fuel channel members 106 intersect.

The effect obtained with the suction filter 102 of the present embodiment is substantially identical to that obtained in the first embodiment or second embodiment. Further, because the mesh 104 is supported by the two fuel channel members 106 in four locations in the circumferential directions, the cylindrical shape of the mesh 104 can be advantageously maintained. The number of fuel channels that communicate the mesh and the fuel pump is not limited to 2 and may be 1 or 3 and more.

Figure 8:
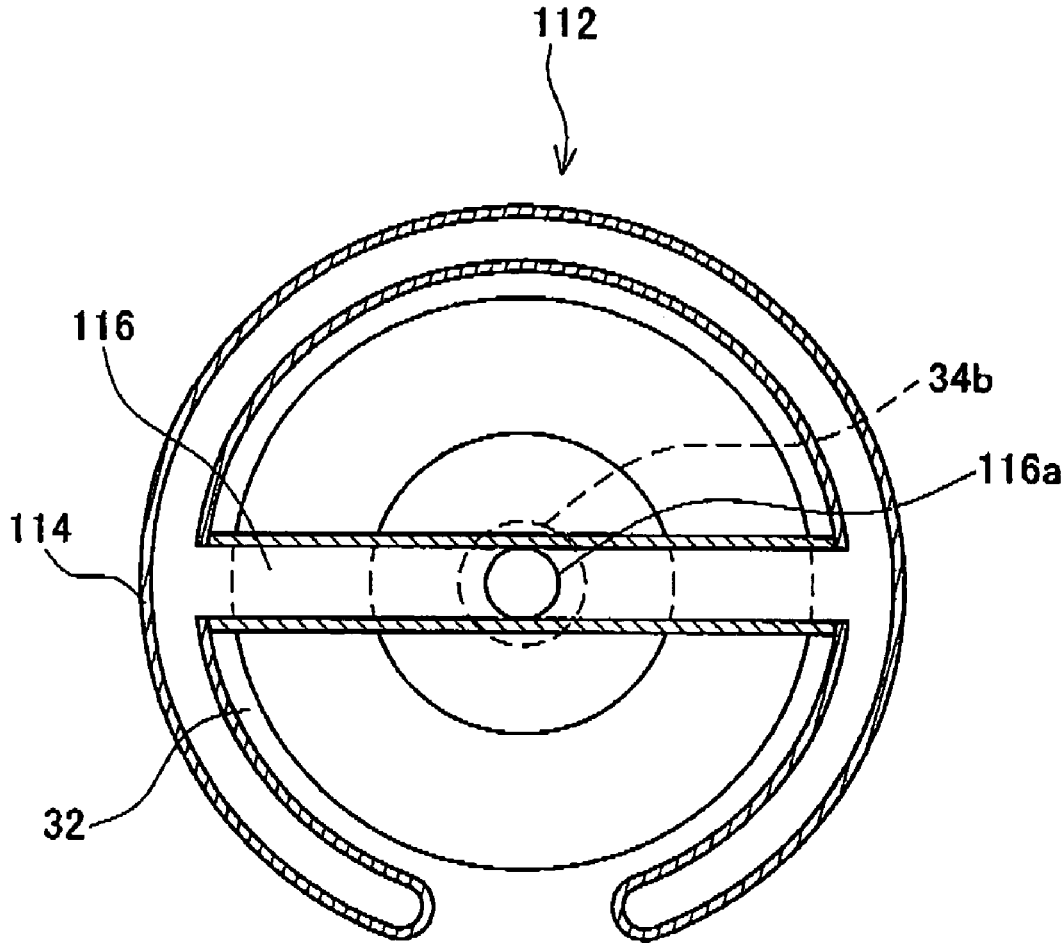
FIG. 8 is a sectional view of the fuel supply device of the sixth embodiment, this view being corresponding to the sectional view along the III-III line in FIG. 1.

(Embodiment 6) The sixth embodiment of the present teachings will be described below. In the present embodiment, the shape of a fuel channel 116 of a suction filter 112 is different from that of the suction filter of the third embodiment. As shown in FIG. 8, in the suction filter 112, a notch is formed in part in the circumferential direction of a mesh 114. One tubular fuel channel member 116 is disposed in the lower portion of the mesh 114. Both ends of the fuel channel member 116 are connected to the mesh 114, and the connection portions are formed to have a trumpet-like shape. The fuel channel member 116 passes through the center of the mesh 114, and a connection portion 116*a* for connection to an intake port 34*b* of the fuel pump 34 is formed in the central portion. The effect obtained with the present embodiment is substantially identical to that obtained with the third embodiment. A plurality of fuel channel members may be also provided in the fuel supply device of the present embodiment.

Figure 9:
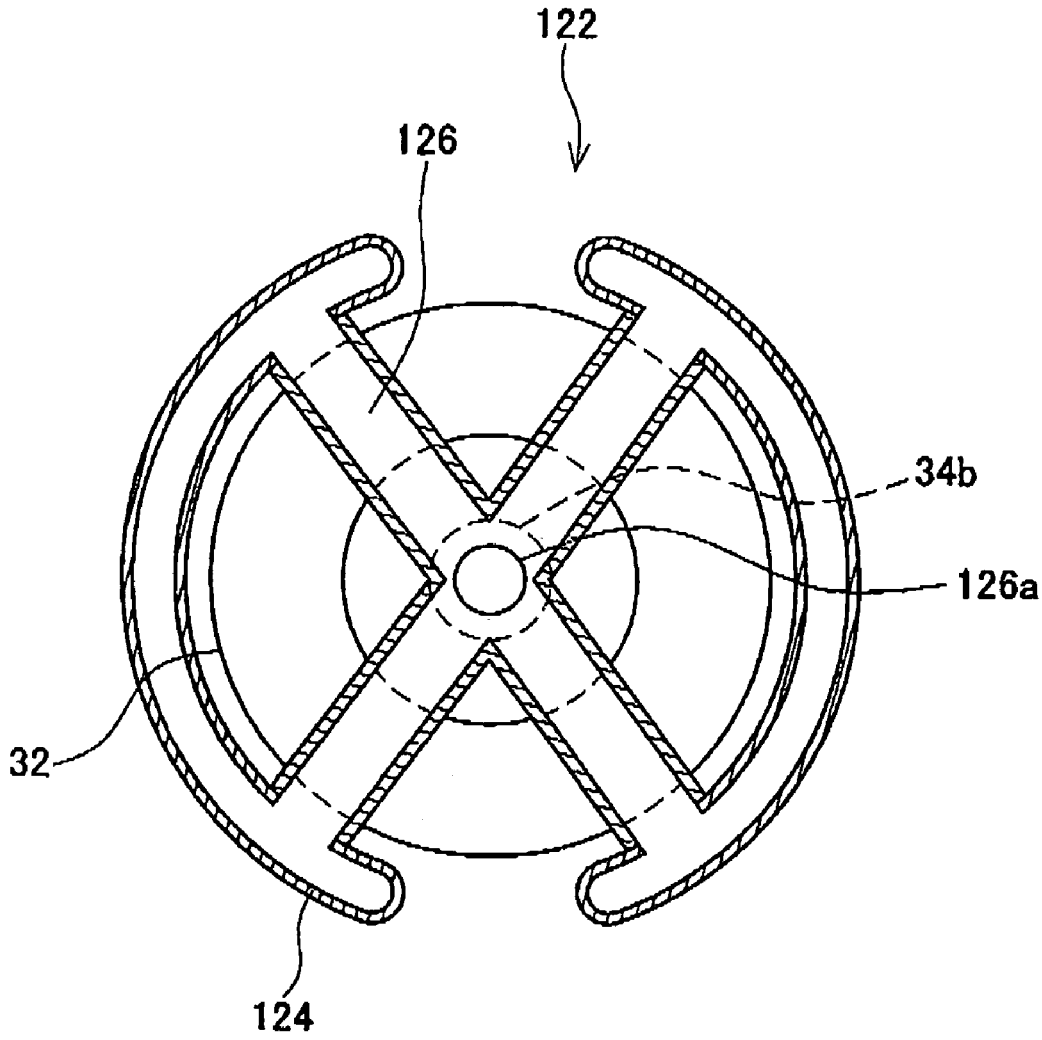
FIG. 9 is a sectional view of the fuel supply device of the seventh embodiment, this view being corresponding to the sectional view along the III-III line in FIG. 1.

(Embodiment 7) The seventh embodiment of the present teachings will be described below. In the present embodiment, the shape of a fuel channel member 126 of a suction filter 122 is partially different from that of the suction filter of the fourth embodiment. As shown in FIG. 9, in the suction filter 122, notches are formed in two location in the circumferential direction of a mesh 124. Two tubular fuel channel members 126 are disposed in the lower portion of the mesh 124. Both ends of each fuel channel member 126 are connected to the mesh 124, and the connection portions thereof are formed to have a trumpet-like shape. The fuel channel members 126 intersect in the center of the mesh 124. A connection portion 126*a* for connection to an intake port 34*b* of the fuel pump 34 is formed in the central portion.

The effect obtained with the present embodiment is substantially identical to that obtained with the fourth embodiment. The number of fuel channel members 126 in the present embodiment also may be 1, or 3 or more.

Figure 10:
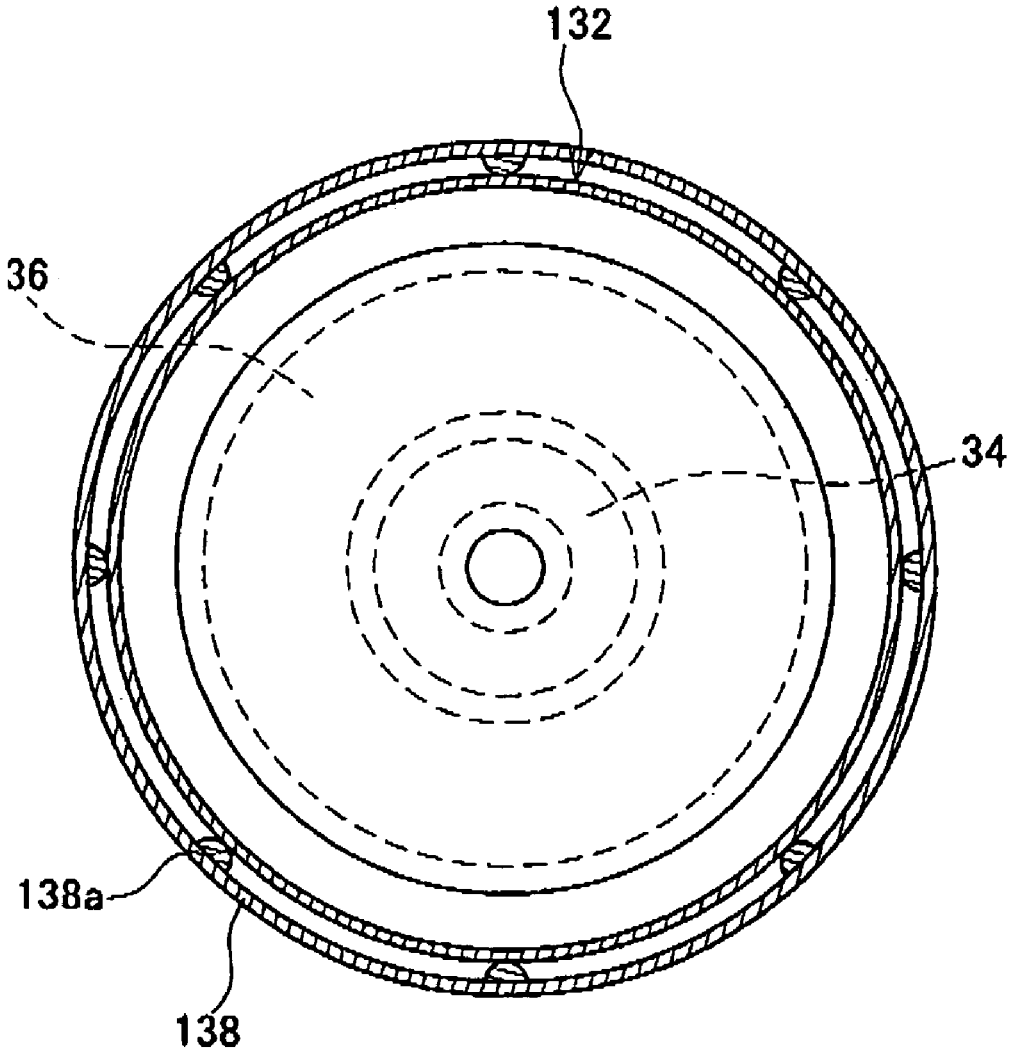
FIG. 10 is a sectional view obtained by cutting the fuel supply device of the eighth embodiment in the horizontal direction in the center of the fuel channel of the suction filter.

(Embodiment 8) The eighth embodiment of the present teachings will be described below. In the present embodiment, the shape of a reservoir cup 138 is different from that of the second embodiment. As shown in FIG. 10, the reservoir cup 138 accommodates a fuel pump 34, a fuel filter 36, and a suction filter 132. Eight ribs 138*a* extending in the up-down direction (i.e., axial line direction of the fuel pump 34) are formed equidistantly at the inner peripheral surface of the reservoir cup 138. The ribs 138*a* protrude toward the center so as come into contact with the outer peripheral surface of the suction filter 132. A gap equal to the protrusion length of the ribs 138*a* is formed between the outer peripheral surface of the suction filter 132 and the inner peripheral surface of the reservoir cup 138.

In the present embodiment, because the ribs 138*a* are formed on the inner peripheral surface of the reservoir cup 138, the outer peripheral surface of the suction filter 132 and the inner peripheral surface of the reservoir cup 138 are not contacted tightly together. As a result, the outer peripheral surface of the suction filter 132 can reliably function as a filtration portion. The shape, number, and positions of ribs 138*a* may be changed appropriately.

Figure 11:
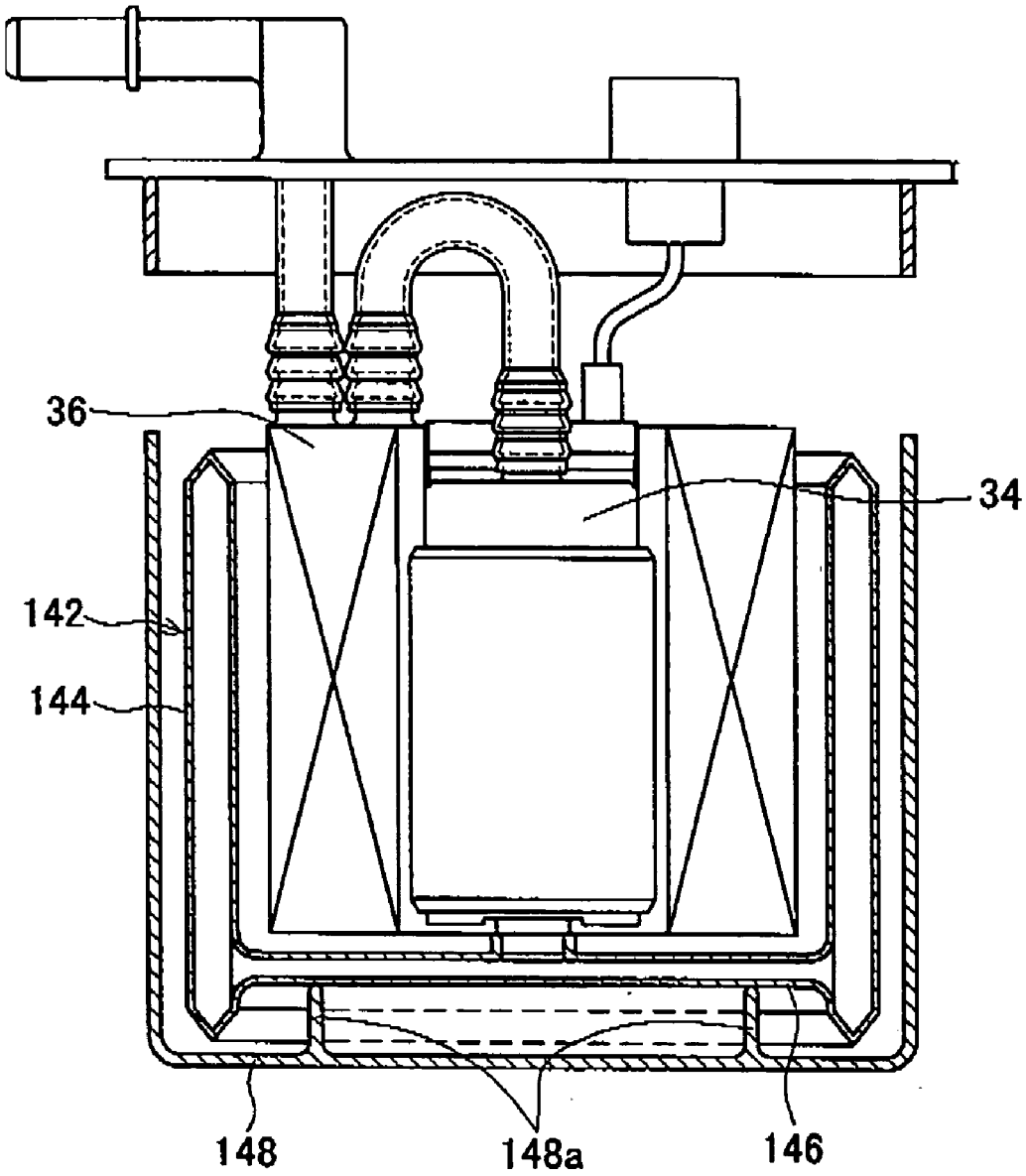
FIG. 11 is a vertical sectional view of the fuel supply device of the ninth embodiment.

(Embodiment 9) The ninth embodiment of the present teachings will be described below. In the present embodiment, the shape of a reservoir cup 148 is partially different from that of the second embodiment. As shown in FIG. 11, the reservoir cup 148 accommodates a fuel pump 34, a fuel filter 36, and a suction filter 142. A rib 148*a* of a cylindrical shape is formed at a bottom surface of the reservoir cup 148. The rib 148*a* protrudes upward from the bottom surface of the reservoir cup 148 and supports the lower surface of a fuel channel member 146 of the suction filter 142. The suction filter 142 is supported by the rib 148*a* in a state such that the lower end of the filter (i.e., lower end of the mesh 144) floats above the bottom surface of the reservoir cup 148.

In the fuel supply device of the present embodiment, the suction filter 142 is supported by the rib 148*a*, which is formed at the bottom surface of the reservoir cup 148, in a state such that the lower end of the mesh 144 floats above the bottom surface of the reservoir cup 148. As a result, the lower end of the mesh 144 is not pressed against the bottom surface of the reservoir cup 148. Therefore, the decrease in the filtration surface areas of the suction filter 142 caused by the deformation of the mesh 144 can be prevented. The shape, number and position of the rib 148*a* may be changed appropriately.

Figure 12:
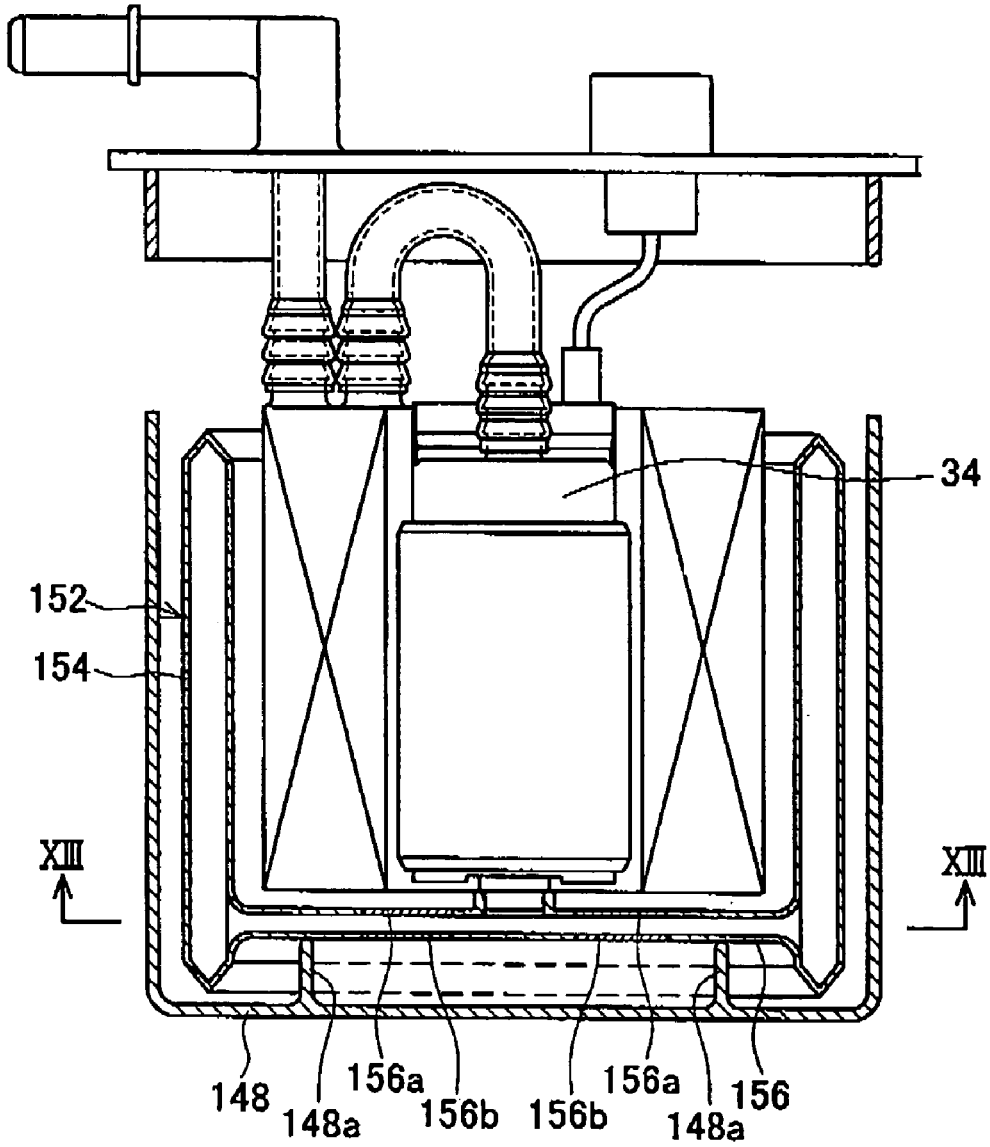
FIG. 12 is a vertical sectional view of the fuel supply device of the tenth embodiment.
Figure 13:
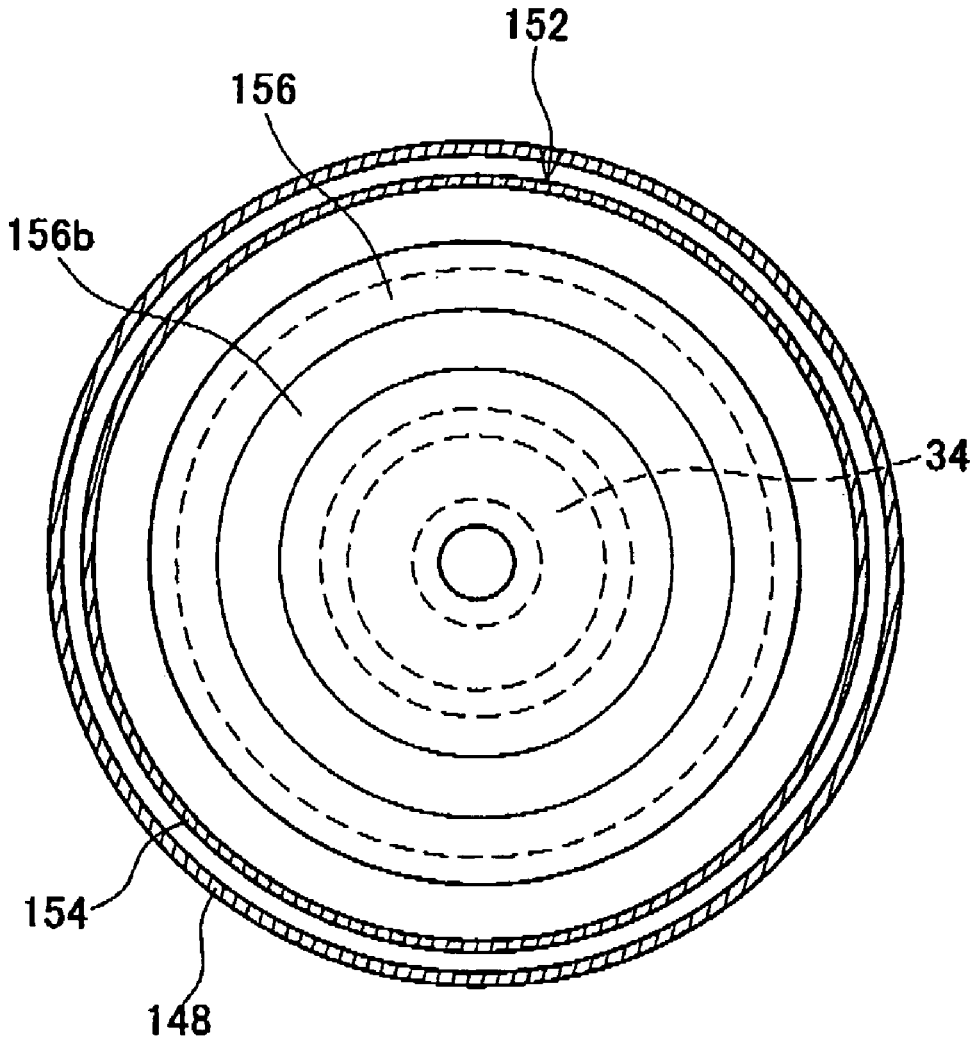
FIG. 13 is a sectional view along the XIII-XIII line in FIG. 12.

(Embodiment 10) The tenth embodiment of the present teachings will be described below. In the present embodiment, the configuration of a fuel channel member 156 is partially different from that of the ninth embodiment. As shown in FIG. 12 and FIG. 13, mesh portions 156*a*, 156*b* are provided concentrically with the fuel channel member 156. The mesh portion 156*a* is formed at the upper surface of the fuel channel member 156. The mesh portion 156*b* is formed at the lower surface of the fuel channel member 156. The mesh portions 156*a*, 156*b* are made from the same material as the mesh 154 of the suction filter 152. A rib 148*a* formed at the bottom surface of a reservoir cup 148 supports a portion (this portion has a certain rigidity) of the lower surface of the fuel channel member 156 outside the mesh portion 156*b*.The suction filter 152 is supported by the rib 148*a* so that the lower end of the mesh 154 is lifted above the bottom surface of the reservoir cup 148.

In the present embodiment because mesh portions 156*a*, 156*b* arc provided in parts of the fuel channel member 156, the fuel filtration portion is provided not only around the fuel pump 34, but also below it. As a result, the filtration surface area is increased and, therefore, the decrease in pump efficiency can be effectively inhibited. Further, because the fuel channel member 156 can be easily deformed by installing the mesh portions 156*a*, 156*b*, it is possible to attenuate or absorb vibrations occurring when the fuel pump 34 is driven. Further, the shape and location of the mesh portions 156*a*, 156*b* provided in the fuel channel member 156 may be changed appropriately.

Finally, although the preferred embodiments have been described in detail, the present embodiments are for illustrative purpose only and are not restrictive. It is to be understood that various changes and modifications may be made without departing from the spirit or scope of the appended claims. In addition, the additional features and aspects disclosed herein may also be utilized singularly or in combination with the above aspects and features.

The invention claimed is:

1. A suction filter comprising:

a filtration member having a first filtration surface, a second filtration surface, and an inner space provided between the first filtration surface and the second filtration surface, each of the first filtration surface and the second filtration surface removing foreign matters contained in fuel; and a connection member having a fuel flow path that connects the inner space of the filtration member to a fuel intake port of a fuel pump, the connection member having a first connection portion configured to be connected to the fuel intake port of the fuel pump and a second connection portion connected to the filtration member, wherein the filtration member is configured to be connected to the fuel intake port of the fuel pump via the connection member, and has a tubular shape so that the filtration member surrounds a circumference of the fuel pump when the first connection portion of the connection member is connected to the fuel intake port of the fuel pump; and the first filtration surface and the second filtration surface are connected at the upper and lower ends thereof in order to provide the inner space between the first filtration surface and the second filtration surface.

2. The suction filter according to claim 1, wherein each of the first filtration surface and the second filtration surface has a tubular shape.

3. The suction filter according to claim 1, wherein the filtration member comprises a plurality of filtration portions, each of the filtration portions has an inner space, and the filtration portions are disposed side by side in the circumferential direction with respect to an axial line of the filtration member.

4. The suction filter according to claim 3, wherein the filtration portions are disposed with a certain spacing in the circumferential direction.

5. The suction filter according to claim 1, wherein the second connection portion is connected to one end of the tubular-shaped filtration member.

6. The suction filter according to claim 5, wherein the second connection portion has a shape gradually expanding toward the filtration member.

7. The suction filter according to claim 6, wherein a filtration surface area of the filtration member is larger than a cross section area of the second connection portion of the connection member.

8. The suction filter according to claim 7, wherein the connection member comprises a first sheet portion and second sheet portion, each of peripheral edges of the first sheet portion and the second sheet portion are connected to the filtration member, and the fuel flow path is provided between the first sheet portion and second sheet portion.

9. The suction filter according to claim 8, wherein one of the first sheet portion and second sheet portion has the first connection portion.

10. A fuel supply device, comprising:

a fuel pump;

a filtration member having a first filtration surface, a second filtration surface, and an inner space provided between the first filtration surface and the second filtration surface, each of the first filtration surface and second filtration surface removing foreign matters contained in fuel; and a connection member connected to the fuel pump and the filtration member, the connection member having a fuel flow path that connects the inner space of the filtration member to a fuel intake port of a fuel pump, wherein the filtration member is connected to the fuel intake port of the fuel pump via the connection member, and has a tubular shape and is arranged with respect to the fuel pump so that an axial direction of the tubular filtration member coincides with a longitudinal direction of the fuel pump and a circumference of the fuel pump is surrounded by the tubular filtration member, and the first filtration surface and the second filtration surface are connected at the upper and lower ends thereof in order to provide the inner space between the first filtration surface and the second filtration surface.

11. The fuel supply device according to claim 10, wherein the filtration member comprises a plurality of filtration portions, each of the filtration portions has an inner space, and the filtration portions are disposed side by side in the circumferential direction with respect to an axial line of the filtration member.

12. The fuel supply device according to claim 11, wherein the filtration portions are disposed with a certain spacing in the circumferential direction.

13. The fuel supply device according to claim 10, wherein the connection member is connected to the filtration member in at least one location in a circumferential direction of the filtration member.

14. The fuel supply device according to claim 10, wherein the connection member is connected to the filtration member along the entire circumference of the filtration member.

15. The fuel supply device according to claim 14, wherein the connection member comprises a first sheet portion and second sheet portion, each of peripheral edges of the first sheet portion and second sheet portion are connected to the filtration member, and a fuel flow path is provided between the first sheet portion and the second sheet portion.

16. An apparatus comprising:

a reservoir cup; and a fuel supply device disposed within the reservoir cup, the fuel supply device comprising a fuel pump, a filtration member, and a connection member, wherein the filtration member has a first filtration surface, a second filtration surface, and an inner space provided between the first filtration surface and the second filtration surface, each of the first filtration surface and the second filtration surface removing foreign matters contained in fuel;

the connection member is connected to the fuel pump and the filtration member, and the connection member having a fuel flow path that connects the inner space of the filtration member to a fuel intake port of the fuel pump, the filtration member is connected to the fuel intake port of the fuel pump via the connection member, and has a tubular shape and is arranged with respect to the fuel pump so that an axial direction of the tubular filtration member coincides with a longitudinal direction of the fuel pump and a circumference of the fuel pump is surrounded by the tubular filtration member, the first filtration surface and the second filtration surface are connected at the upper and lower ends thereof in order to provide the, inner space between the first filtration surface and the second filtration surface, and a gap is provided in at least one location in the circumferential direction between an inner wall of the reservoir cup and an outer peripheral surface of the filtration member.

17. The apparatus according to claim 16, wherein the reservoir cup has a protrusion on an inner wall of a bottom surface, and the protrusion is in contact with the connection member.

18. The apparatus according to claim 17, wherein the connection member has a filtration portion.

19. A suction filter comprising:

a filtration member having an inner space; and a connection member configured to communicate the inner space of the filtration member and a fuel intake port of a fuel pump, the connection member having a first connection portion configured to be connected to the fuel intake port of the fuel pump, wherein the filtration member has a tubular shape so that the filtration member surrounds a circumference of the fuel pump when the first connection portion of the connection member is connected to the fuel intake port of the fuel pump, and the connection member comprises a second connection portion connected to one end of the tubular-shaped filtration member, the second connection portion having a shape gradually expanding toward the filtration member.

* * * * *